US005465316A

United States Patent [19]

Tanaka

[11] Patent Number: 5,465,316

[45] Date of Patent: Nov. 7, 1995

[54] METHOD AND DEVICE FOR CODING AND DECODING SPEECH SIGNALS USING INVERSE QUANTIZATION

[75] Inventor: Yosahinori Tanaka, Kawasaki, Japan

[73] Assignee: Fujitsu Limited, Kanagawa, Japan

[21] Appl. No.: 108,889

[22] Filed: Aug. 18, 1993

[30] Foreign Application Priority Data

Feb. 26, 1993 [JP] Japan ..... 5-039021

[51] Int. Cl.[6] ..... G10L 9/00

[52] U.S. Cl. ..... 395/2.28; 395/2.29; 395/2.32

[58] Field of Search ..... 395/2.28, 2.32; 381/36, 40, 37, 38, 39

[56] References Cited

U.S. PATENT DOCUMENTS

| | | | |
|---|---|---|---|
| 4,924,508 | 5/1990 | Crepy et al. | 395/2.28 |
| 4,965,789 | 10/1990 | Bottau et al. | 395/2.28 |
| 5,060,268 | 10/1991 | Asakawa et al. | 395/2.28 |
| 5,206,884 | 4/1993 | Bhaskar | 395/2.28 |
| 5,307,441 | 4/1994 | Tzeng | 395/2.31 |
| 5,327,520 | 7/1994 | Chen | 395/2.28 |
| 5,341,456 | 8/1984 | DeJaco | 395/2.28 |

*Primary Examiner*—Allen R. MacDonald
*Assistant Examiner*—Michael A. Sartori

[57] ABSTRACT

The present invention relates to method and device for coding speech and to method and device for inverse-quantizing signals coded by the speech coding method. The object of the present invention is to realize an improved coding accuracy and an improved predictive gain by using a correlation between frames of a spectrum, if necessary, in an coding step. A first filter uses a coefficient determined by a predictive coefficient analyzed in a previous frame. After an input speech signal is subjected to a inverse filtering process by the first filter, the first predictive residual signal obtained is subjected to a linear predictive coding to obtain a predictive coefficient. A second filter subjects the predictive coefficient to an inverse filtering process and the resultant second predictive residual signal is quantized.

14 Claims, 14 Drawing Sheets

METHOD AND DEVICE FOR CODING AND DECODING SPEECH SIGNALS USING INVERSE QUANTIZATION

BACKGROUND OF THE INVENTION

1) Field of the Invention

The present invention relates to a speech coding method which executes a linear predictive coding of an input speech signal and quantizes and transmits the predictive error signal and a device employing the same, and a speech decoding method which executes an inverse quantization of a signal coded by the speech coding method and a device employing the same.

2) Description of the Related Art

In recent years, a speech coding device which compresses speech signal at high efficiency and a speech decoding device which decodes the coded signal have been demanded for intracompany communications systems, digital mobile radio systems, speech store systems, and similar systems.

Conventional speech predictive coding device multiplexes and outputs a parameter (predictive coefficient) extracted through a linear predictive coding to every frame and a parameter of an excitation signal which drives a predictive synthesis filter having the predictive coefficients as coefficients. In the decoding device, a predictive synthesis filter receives the excitation signal to reproduce a speech signal.

The all-pole type model determined by a linear predictive coding is known to be a good model of a speech producing process. For the high efficiency speech signal coding, a device which transmits linear predictive coefficients determined through a linear predictive coding analysis and parameters relating to a voice source has been widely used.

FIG. 14 shows the configuration of a conventional speech coding device. Referring to FIG. 14, the speech coding device includes a linear predictive analyzing unit 101 for performing a linear predictive coding on an input signal to calculate predictive coefficients, a predictive coefficient quantizing unit 102 for quantizing predictive coefficients calculated in the linear predictive analyzing unit 101, an inverse filter 103 for executing an inverse filtering process based on the quantizing predictive coefficient from the predictive coefficient quantizing unit 102 to determine predictive residual signals, a residual signal quantizing unit 104 for quantizing the predictive residual signal from the inverse filter 103, and a multiplexing unit (MUX) 105 for multiplexing predictive residual signal quantizing codes and predictive coefficient quantizing codes to transmit the outcome to a speech decoding device.

FIG. 15 is a diagram showing the configuration of a conventional speech decoding device. The speech decoding device, shown in FIG. 15, includes a demultiplexing unit (DEMUX) 111 for demultiplexing a signal inputted from a speech coding device through a transmission line, a predictive coefficient inverse quantizing unit 112 for executing an inverse quantizing process to predictive coefficient quantizing codes from the speech coding device, demultiplexed in the demultiplexing unit 111, a residual signal inverse quantizing unit 113 for executing an inverse quantizing process on the predictive residual signal quantizing code from the speech coding device, and a filter 114 for reproducing speech signal by executing a filtering process on the inverse-quantized predictive residual signal based on the inverse-quantized predictive coefficients.

In the speech coding device and the speech decoding device with such a conventional configuration, a signal is sampled every fixed length of span (frame) of an input signal by executing a window process, and then the sampled signal is subjected to a linear predictive coding every frame unit. Generally, the spectrum envelope every speech frame in a short time has a high correlation between adjacent frames.

In the coding, the analysis order is usually a fixed value and signals except of the analyzing span are not used. The speech decoding device receives predictive coefficient quantizing codes and predictive residual signal quantizing codes from the speech coding device to subject them to an inverse quantizing process. Filter coefficients are determined based on the resultant quantized predictive coefficients and then a speech signals are reproduced by performing a filtering process on the quantized predictive residual signals.

In order to transmit efficiently a speech signal information, there are a code excited linear predictive coding device (CELP) which vector-quantizes excitation signals and transmits its indices, and a multi-pulse excitation coding device (MPC) which models excitation signals as finite numbr of pulses and transmits optimum pulse positions and pulse amplitudes.

As described above, the predictive coefficients analyzed every frame have a high correlation between the values analyzed on adjacent frames because of a small change in the spectrum in a speech stationary period. In order to improve the quantizing efficiency of the predictive coefficients by utilizing the interframe correlation to analyzed predictive coefficients, a predictive coding and a finite state vector quantizing are known.

The conventional speech coding device and speech decoding device do not utilize any interframe correlation in the analysis stage, but utilize an interframe correlation only at the quantizing stage. Therefore, there is a disadvantage in that the interframe correlation is not used to improve prediction gain.

The change in the spectrum is large in a transient speech period, and the correlation between analyzed values in adjacent frames is low. Hence, it is required that the predictive coefficients which are subjected to a linear predictive coding are not needed to utilize the interframe correlation during the above periods

SUMMARY OF THE INVENTION

The present invention is made to overcome the above mentioned problems. An object of the present invention is to provide a method and a device for coding speech, which realize an improved coding accuracy and an improved predictive gain by using a correlation between spectra of successive frames, if necessary, in an analysis stage.

Another object of the present invention is to provide a method and a device for decoding speech, which realize an improved coding accuracy and an improved predictive gain by using a correlation between spectra of successive frames, if necessary, in a coding step.

In order to achieve the above objects, a speech coding method of the present invention is characterized by the steps of performing an inverse filtering process on an input speech signal by a first filter, the first filter using coefficients obtained from predictive coefficients, the predictive coefficients being obtained by analyzing a previous frame; performing a linear predictive coding analysis on the first predictive residual signal obtained by the inverse filtering step to obtain predictive coefficients; performing an inverse filtering process by a second filter by using the predictive coefficients to obtain a second predictive residual signal; and quantizing the second predictive residual signal obtained by the inverse filtering process on the second filter.

According to the present invention, a speech coding device is characterized by a first filter for performing an inverse filtering process on an input speech signal and issuing a first predictive residual signal; a second filter for performing an inverse filtering process on the first predictive residual signal obtained from the first filter and issuing a second predictive residual signal; quantizing means for quantizing the second predictive residual signal received from the second filter; linear predictive analyzing means for performing a linear predictive coding based on the first predictive residual signal from the first filter and extracting predictive coefficients for the second filter to determine the filter characteristic of the second filter; and calculating means for the first filter for calculating predictive coefficients for the first filter to determine the filter characteristic of the first filter, using predictive coefficients of a previous frame, whereby the first filter determines its filter characteristic based on the predictive coefficients obtained by the calculating means, performs an inverse filtering process of an input speech signal using the filter characteristic, and issues the first predictive residual signal, and whereby the second filter determines a filter characteristic based on the second filter predictive coefficients obtained by the linear predictive analyzing means, performs an inverse filtering process on the first predictive residual signal using the filter characteristic, and issues the second predictive residual signal.

According to a speech coding device of the present invention, the order of the first filter is smaller than that of the second filter.

According to a speech coding device of the present invention, the calculating means for the first filter includes total predictive coefficients calculating means for determining total predictive coefficients from the first filter predictive coefficients and the second filter predictive coefficients of a previous frame; first converting means for converting the total predictive coefficients obtained by the total predictive coefficients calculating means into reflective coefficients; order truncating means for truncating the order of the first filter to the other reflective coefficients converted by the first converting means; and second converting means for converting the reflective coefficients into the first filter predictive coefficients processed by the order truncating means.

In a speech coding device according to the present invention, the calculating means for the first filter includes first selecting means for determining a plurality of predictive coefficient candidates for the first filter; and second selecting means for selecting an optimum predictive coefficient for the first filter from the predictive coefficient candidates selected by the first selecting means.

Moreover, a speech coding device according to the present invention is characterized in that the first selecting means includes total predictive coefficient calculating means for determining a plurality of total predictive coefficients from the first filter predictive coefficients and the second filter predictive coefficients of a previous frame; first converting means for converting the plurality of total predictive coefficients obtained by the total predictive coefficient calculating means into a plurality of corresponding reflective coefficients; order truncating means for truncating the corresponding order of the first filter with respect to the plurality of reflective coefficients converted by the first converting means; and second converting means for converting the plurality of reflective coefficients processed by the order truncating means into first filter predictive coefficient candidates.

A speech coding device according to the present invention also is characterized in that the first filter predictive coefficient candidates include coefficients which ensure that the first filter has a through-characteristic.

The second selecting means selects as said first filter predictive coefficients a predictive coefficient candidate minimizing the predictive residual signal power, from a predictive coefficient candidate selected by the first selecting means.

A speech coding device according to the present invention is characterized by a first filter for performing an inverse filtering process on an input speech signal and issuing a first predictive residual signal; by-pass route means for by-passing the first filter; a selector for selections the first filter or the by-pass route means; a second filter for performing an inverse filtering process on a signal selected by the selector and issuing a second predictive residual signal; quantizing means for quantizing the second predictive residual signal recovered from the second filter; linear predictive analyzing means for performing a linear predictive coding based on a signal selected by the selector and for extracting the second filter predictive coefficients to determine the filter characteristic of the second filter; calculating means for the first filter for calculating the first filter predictive coefficients using predictive coefficients of a previous frame to determine the filter characteristic of the first filter; and selector control means for switching the selector based on a predictive residual signal, whereby in the first filter, when the power of the predictive residual signal is smaller than a reference value, the first predictive residual signal is outputted after subjecting an input speech signal to an inverse filtering process to determine a filter characteristic, the first filter characteristic being determined based on the first filter predictive coefficients obtained by the calculating means for the first filter, and is selected by the selector and when the predictive residual signal power is larger than the reference value, the selector selects an input speech signal by way of the by-pass route means, while the second filter determines its filter characteristic based on the second filter predictive coefficient extracted by the linear predictive analyzing means, performs an inverse filtering process on the first predictive residual signal or the input speech signal from said selector in accordance with the obtained filter characteristic, and issues the second predictive residual signal.

A speech decoding method according to the present invention is characterized by the steps of performing an inverse quantization on a quantization predictive residual signal in accordance with a quantizing code sent from a quantizing means in a coding device; subjecting an inverse-quantized predictive residual signal to a composite filtering process using a third filter, the third filter using predictive coefficients sent from a linear predictive analyzing means in the coding device; and subjecting the output of the third filter to a composite filtering process using a fourth filter, the fourth filter determining a characteristic based on a predictive coefficient information sent from a predictive coefficient calculating means, the predictive coefficient calculating means calculating the other predictive coefficients from predictive coefficients of a previous frame in the coding device.

Moreover, a speech decoding device according to the present invention is characterized by inverse-quantizing means for inverse-quantizing a quantizing predictive residual signal in accordance with a quantizing code sent from quantizing means in a speech coding means; a third filter for determining its filter characteristic based on predictive coefficients sent from a linear predictive analyzing means in the speech coding device and for subjecting the predictive residual signal inverse-quantized by the inverse quantizing means to a filtering process in accordance with said filter characteristic; and a fourth filter for determining its filter characteristic based on predictive coefficients sent from predictive coefficients calculating means, the predictive coefficient calculating means calculating the other predictive coefficients from predictive coefficients in a previous frame in the speech coding device and subjecting an output signal from the third filter to a filtering process using the filter characteristic.

A speech decoding device according to the present invention is characterized by inverse-quantizing means for inverse-quantizing a quantizing predictive residual signal sent from quantizing means in a speech coding device; a third filter for determining its filter characteristic based on predictive coefficients sent from a linear predictive analyzing means in the speech coding device and subjecting the predictive residual signal inverse-quantized by the inverse quantizing means to a filtering process using the filter characteristic; a selector for switching in accordance with a selector switching information sent from selector control means in the speech coding means; a fourth filter connected to one switching route of said selector for subjecting the output of the selector into a filtering process; and a by-pass route means connected to another switching route of the selector for by-passing the fourth filter.

Furthermore, in a speech decoding device according to the present invention, the order of said fourth filter is lower than that of the third filter.

In the speech coding device of the present invention, the first filter executes an inverse filtering process on an input speech signal and outputs a first predictive residual signal, and the second filter executes an inverse filtering process on the first predictive residual signal and outputs a second predictive residual signal.

Next, the quantizing means quantizes the second predictive residual signal from the second filter. In order to determine the filter characteristic of the second filter, the linear predictive analyzing means performs a linear predictive coding based on the first predictive residual signal from the first filter and extracts the second filter predictive coefficients.

In order to determine the filter characteristic of the first filter, the calculating means for the first filter analyzes predictive coefficients in a previous frame, and calculates predictive coefficients for the first filter.

Furthermore, in the inverse filtering process of the first filter, the filter characteristic is determined based on a first filter predictive coefficient determined by the calculating means for the first filter and a first predictive residual signal is issued by subjecting the input speech signal to an inverse filtering process in accordance with the filter characteristic.

In the process of the second filter, the filter characteristic is determined based on the predictive coefficients for the second filter extracted by the linear predictive analyzing means and the second predictive residual signal is issued by performing an inverse filtering process of the first predictive residual signal in accordance with the filter characteristic.

The calculating means for the first filter can calculate the first filter predictive coefficients, as explained below. The total predictive coefficient calculating means determines total predictive coefficients from the first filter predictive coefficients and the second filter predictive coefficients of the previous frame. The obtained total predictive coefficients are converted to reflective coefficients by means of the first converting means.

Next, the order truncating means subjects the reflective coefficients converted to a truncating process based on the order of the first filter. The second converting means converts the reflective coefficients processed by the order truncating means into a first filter predictive coefficients and then outputs the outcome.

Moreover, the calculating means for the first filter can calculate the first filter predictive coefficients as follows:

The predictive coefficient candidate selecting means in the calculating means for the first filter determines a plurality of first filter predictive coefficient candidates. The selecting means selects the optimum first filter predictive coefficients from the predictive coefficient candidates selected by the predictive coefficient candidate selecting means.

In the above case, the predictive coefficient candidate selecting means calculates a predictive coefficient candidate as follows:

The total predictive coefficients calculating means determines a plurality of total predictive coefficients from the first filter predictive coefficients and the second filter predictive coefficients in the plurality of previous frames. The first converting means converts a plurality of total predictive coefficients obtained by the total predictive coefficient calculating means into a plurality of corresponding reflective coefficients.

Next, the order truncating means subjects a plurality of reflective coefficients converted by the first converting means to the truncating process in accordance with the order of the corresponding first filter. The second converting means converts a plurality of reflective coefficients processed by the order truncating means into predictive coefficient candidates for the first filter, and then produces them.

The predictive coefficient candidates for the first filter include a candidate which makes the first filter having a through characteristic. As described above, when the first filter is constituted as a variable order filter, the selecting means in the first predictive calculating means for the first filter selects as predictive coefficients for the first filter a predictive coefficient candidate which minimizes the predictive residual signal power from the predictive coefficient candidate selected by the predictive coefficient candidate selecting means.

The speech coding device according to the present invention can operate as follows:

The selector issues selectively a signal obtained by subjecting an input speech signal to an inverse filtering process by the first filter or a signal by-passing the first filter via a by-pass route means.

The second filter executes an inverse filtering process on a signal selected by the selector and outputs a second predictive residual signal. The quantizing means quantizes the second predictive residual signal from the second filter.

The second filter characteristic is determined by performing a linear predictive coding based on the first predictive residual signal from the first filter in the linear predictive analyzing means and extracting predictive coefficients for the second filter.

The filter characteristic of the first filter is determined by analyzing predictive coefficients of a previous frame by the calculating means for the first filter and then calculating predictive coefficients for the first filter.

The selector control means switches the selector in accordance with a predictive residual signal power. The switching operation is performed as follows:

In the first filter, when the predictive residual signal power is smaller than a reference value, the selector is switched so as to select the first predictive residual signal in accordance with a filter characteristic, the signal being obtained by subjecting an input speech signal to an inverse filtering process, the filter characteristic being determined based on the first filter predictive coefficient obtained by the calculating means for the first filter. When the predictive residual signal power is larger than the reference value, the selector is switched so as to select the input speech signal inputted via the by-pass route means.

In the inverse filtering process of the second filter, a filter characteristic is determined based on predictive coefficients for the second filter extracted by the linear predictive analyzing means. In accordance with the filter characteristic, an inverse filtering process is performed to the first predictive residual signal or the input speech signal in the selector to produce a second predictive residual signal.

The speech decoding device according to the present invention can separate as follows:

The inverse quantizing means inverse-quantizes the quantizing codes of the predictive coefficients sent from the quantizing means in a speech coding device. Sequentially, the third filter determines its filter characteristic based on the predictive coefficients sent from the linear predictive coefficient analyzing means in the speech coding device, and subjects the predictive residual signal inverse-quantized by the inverse quantizing means to a filtering process in accordance with the filter characteristic.

The fourth filter determines its filter characteristic based on an predictive coefficient information, the information being sent from the predictive coefficient calculating means which calculates the other predictive coefficients from predictive efficients of a previous frame in the speech coding device. The output signal from the third filter is subjected to a filtering process according to the filter characteristic.

Furthermore, the speech decoding device according to the present invention may separate in accordance with the following procedure.

The inverse quantizing means inverse-quantizes a predictive residual signal quantizing code sent from the quantizing means in the speech coding device. Next, the third filter determines its filter characteristic based on predictive coefficients sent from the linear predictive analyzing means in the speech coding device, and then subjects the predictive residual signal inverse-quantized by the inverse quantizing means to a filtering process, utilizing the filter characteristic.

The selector outputs selectively a signal processed by the third filter to either the fourth filter connected to one switching path thereof or the by-pass route means connected to the other switching path thereof, based on a selector switching information sent from the selector control means in the speech coding device.

When the selector is connected to one switching route, the fourth filter performs an inverse filtering process on the output signal of the selector. When the selector is connected to the other switching route, the fourth filter is by-passed.

According to the above configuration of the present invention, since the speech coding device transmits with bit information added, there are the following advantages as for speech signal reproduction:

(a) Since a small span of spectrum changes of an input speech signal, for example, a stationary voiced period is subjected to an additional linear predictive analysis by using the output from the first filter, the predictive gain becomes higher than that of the conventional configuration obtained by only the second filter, whereby the accuracy of the linear predictive coding can be improved.

(b) When an input speech signal has a large change in spectrum, the degradation of the predictive gain can be prevented by making the first filter in a through characteristic state.

(c) Since the first filter includes a plurality of candidates including a candidate with a through characteristic and an optimum coefficient is selected from them, the characteristic degradation can be eliminated even in the periods where the spectrum of an input signal is changing, whereby the accuracy of the linear predictive coding can be more improved.

DESCRIPTION OF THE PREFERRED EMBODIMENTS

Referring to the attached drawings, an explanation will be made in detail as for preferred embodiments of the method and device for coding speech and method and device for decoding speech according to the present invention.

(a) Explanation of the First Embodiment

Figure 1:
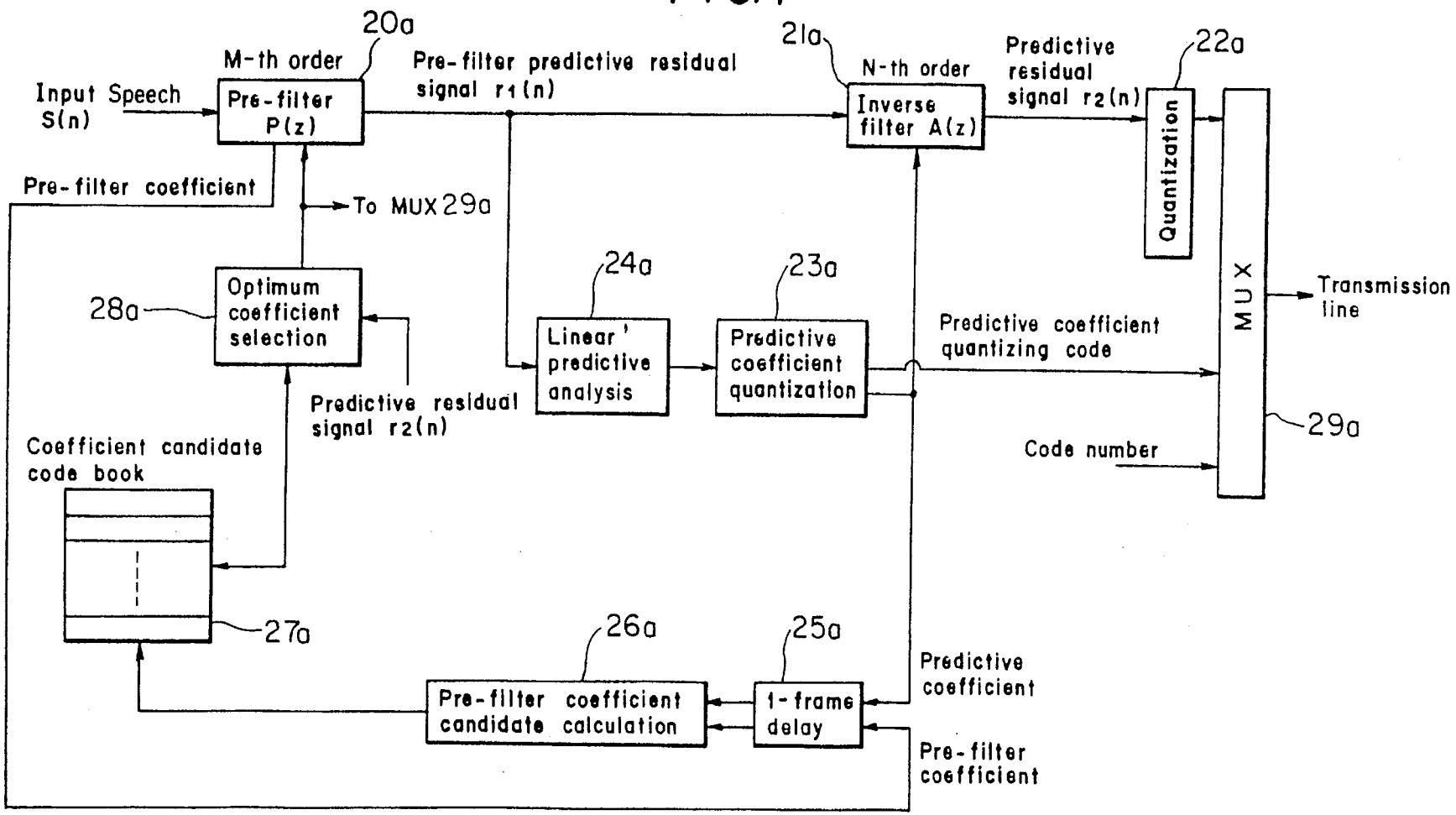
FIG. 1 is a block diagram showing a speech coding device according to the first embodiment of the present invention.

FIG. 1 is a block diagram showing a speech coding device according to the first embodiment of the present invention. Referring to FIG. 1, the speech coding device is constituted of a pre-filter 20*a* as a first filter, an inverse filter 21*a* as a second filter, a quantizing unit 22*a* as quantizing means, a linear predictive analyzing unit 24*a* as linear predictive analyzing means, a frame delay unit 25*a* as predictive coefficient calculating means for the first filter, a pre-filter coefficient candidate calculating unit 26*a*, a coefficient candidate code book 27*a*, an optimum coefficient selecting unit 28*a*, a predictive coefficient quantizing unit 23*a*, and a multiplexing unit (MUX) 29*a*.

The pre-filter 20*a* as the first filter executes an inverse filtering process on an input speech signal and outputs a pre-filter predictive residual signal r1(n).

The inverse filter 21*a* as the second filter executes an inverse filtering process on a pre-filter predictive residual signal r1(n) from the pre-filter 20*a* and outputs the outcome as a predictive residual signal r2(n).

The pre-filter 20*a*, for example, executes an inverse filtering process using a M-th order (M is a variable) filter coefficient and the in verse filter 21*a* executes an inverse filtering process using an N-th order filter coefficient. The M-th order of the pre-filter 20*a* is lower than N-th order of the inverse filter 21*a*. The quantizing unit 22*a* as quantizing means quantizes a predictive residual signal r2(n) from the inverse filter 21*a* to output the outcome to the multiplexing unit 29*a*.

The linear predictive analyzing unit 24*a* as linear predictive analyzing means extracts a predictive coefficient for the inverse filter 21*a* for determining the filter characteristic of the inverse filter 21*a*, based on a pre-filter predictive residual signal r1(n) from the pre-filter 20*a*. The predictive coefficient quantizing unit 23*a* quantizes predictive coefficients for the inverse filter from the linear predictive analyzing unit 24*a* to issue the outcome to the inverse filter 21*a*, the frame delay unit 25*a* and the multiplexing unit 29*a*.

The frame delay unit 25*a* extracts a predictive coefficient information and a pre-filter coefficient information of a previous frame which are used to calculate pre-filter coefficients to determine the filter characteristic of the pre-filter 20*a*. For example, the frame delay unit 25*a* extracts a predictive coefficient information and a pre-filter coefficient information of a frame earlier by one frame with respect to the current frame information.

The pre-filter coefficient candidate calculating unit (predictive coefficient candidate selecting means) 26*a* determines, for example, a plurality of pre-filter coefficient candidates with different orders. The pre-filter coefficient candidate calculating unit 26*a*, as shown in FIG. 2, is constituted of a convolutional operation unit (total predictive coefficient calculating means) 41*a*, a first coefficient converting unit (first converting means) 42*a*, an order truncating unit (order truncating means) 43*a*, and a second coefficient converting unit (second converting means) 44*a*.

Figure 2:
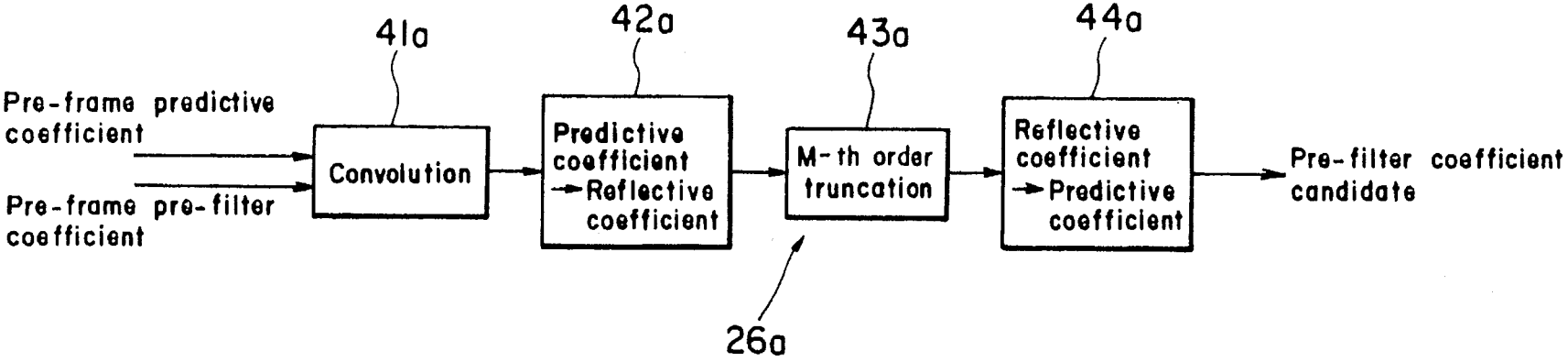
FIG. 2 is a block diagram showing a pre-filter candidate calculating unit in the speech coding device according to the first embodiment of the present invention.

In FIG. 2, the convolutional operation unit 41*a* determines a plurality of total predictive coefficients of a previous frame. In concrete, the total predictive coefficients are determined through the following calculation.

For example, when the previous predictive coefficient {bi} earlier by 1-frame to the current frame of the pre-filter 20*a* is given by the expression (1) and the previous predictive coefficient {ci} earlier by 1-frame to the current frame of the inverse filter 21*a* is given by the expression (2), the composite characteristic is given by the expression (3). The predictive coefficient, as given by the expression (4), is obtained by convoluting the predictive coefficients {bi} and {ci}.

$$\{bi\}=(b0, b1, \ldots, bM) \tag{1}$$

$$\{ci\}=(c0, c1, \ldots, cN) \tag{2}$$

$$H(z)=P(z)A(z) \tag{3}$$

$$a_n = \sum_{i=0}^{M} b_i C_{n-1} \quad (n = 0 \sim N+M) \tag{4}$$

The first coefficient converting unit 42*a* converts a plurality of total predictive coefficients from the convolutional operating unit 41*a* into a plurality of corresponding reflective coefficients. In concrete, the calculation is performed as follows:

For example, the convolutional operation unit 41*a* converts the above total predictive coefficient {an} into the reflective coefficient {kn} expressed by the expression (5).

$$ki=ai^{(i)}$$

$$aj^{(i-1)}=(aj^{(i)}+ai^{(i)}ai-j^{(i)})/(1-ki^2) \quad (1 \leqq j \leqq j-1)$$

In this case, i decreases from p to p−1, . . . , 1, and is set first as expressed by the following expression:

$$aj^{(p)} = ai \quad (1 \leqq j \leqq p) \tag{5}$$

As described above, the convolutional operation unit 41*a* and the first coefficient converting unit 42*a* calculates and converts to obtain a plurality of (N+M)-th order refelective {kn}. The order truncating unit 43*a* truncates the (N+M)-th order reflective coefficient to make a M-th order reflective coefficient. That is, the expression, {kn}={k0, k1, . . . , KM, . . . , KM+N}, is obtained by truncating the expression, {kn}={k0, k1, . . . , KM}, to the coefficients kM+1~kM+N.

The second coefficient converting unit 44*a* converts a reflective coefficient processed by the order truncating unit 43*a* to a predictive coefficient and issues the outcome as a pre-filter coefficient candidate. In concrete, the predictive coefficient is obtained through the following calculation.

The reflective coefficient {kn} processed by the order truncating unit 43*a*, for example, is converted to a predictive coefficient in accordance with the expression (6).

$$ai^{(i)} = Ki$$

$$aj^{(i)} = aj^{(i-1)} - Ki\, a\, (i-j)^{(i-1)} \quad (1 \leqq j \leqq i-1)$$

The above expressions are solved regarding i=1, 2, . . . , p. A predictive coefficient is determined by arranging the following expression (6) from the final coefficient set:

$$aj=aj^{(p)} \tag{6}$$

As described above, in order to convert the (M+N)-th order predictive coefficient to a M-th order coefficient, the (M+N)-th order predictive coefficient is once converted to a reflective coefficient to truncate the order, and it is reconverted to a predictive coefficient. This is because it is impossible to truncate directly the predictive coefficient.

The coefficient code book 27*a* stores a plurality of pre-filter coefficient candidates calculated by the pre-filter coefficient candidate calculating unit 26*a*. There are two modes as a method of calculating a plurality of pre-filter coefficients stored.

In one mode, the pre-filter coefficient and the predictive coefficient of a plurality of previous frames are used as a fixed M-th order coefficient of the pre-filter 20*a* to accumulate and store the coefficient calculated as a pre-filter coefficient candidate. In the other mode, the pre-filter coefficient and the predictive coefficient of the previous frame preceding a frame, as a coefficient with a variable order of the pre-filter 20*a*, is used to store pre-filter coefficients candidates of various kinds of orders.

In either pre-filter coefficient candidate calculating method, the characteristic which passes an input speech signal through the pre-filter 20*a* without changing its signal characteristic (or which is a through characteristic making the pre-filter 20*a* OFF) is calculated and stored. Since the interframe correlation of a predictive coefficient is small in a span where an input speech signal has a large spectrum change, the degradation of the predictive gain is prevented due to the use of the pre-filter 20*a*.

Figure 3:
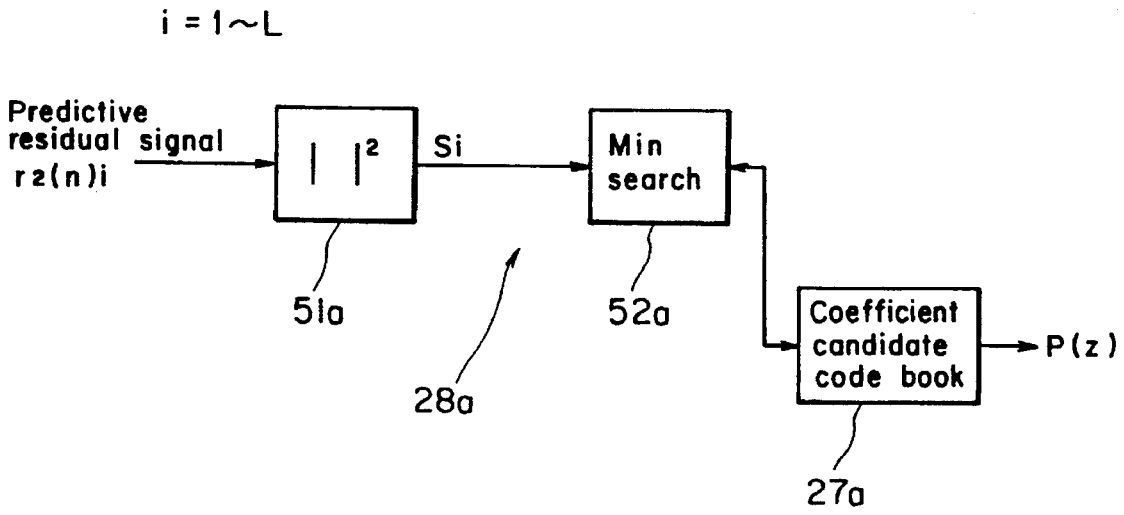
FIG. 3 is a block diagram showing an optimum coefficient selection unit of the speech coding device according to the first embodiment of the present invention.

The optimum coefficient selecting unit (selecting means) 28*a*, as shown in FIG. 3, selects a predictive coefficient candidate minimizing the predictive residual signal power as the optimum pre-filter coefficient from a plurality of pre-filter coefficient candidates determined by the pre-filter coefficient candidate calculating unit 26*a*.

In FIG. 3, the pre-filter 20*a* and the inverse filter 21*a* execute an inverse filtering process on each of pre-filter coefficient candidates of, for example, L in number stored in the coefficient code book 27*a* to makes a predictive residual signal r2(n)i, (i=1~L). The square OR operation unit 51*a* determines a square OR of the predictive residual signal r2(n)i (where i=1~L) to calculate the residual signal power.

The minimum value retrieving unit 52*a* retrieves the minimum value of L power values calculated by the square OR operation unit 51*a*. The pre-filter coefficient candidate based on the minimum operation value is outputted as the optimum pre-filter coefficient.

The minimum value retrieving unit 52*a* outputs a code number to the coefficient candidate code book 27*a* and outputs the corresponding pre-filter coefficient candidate information to the pre-filter 20*a*.

The optimum coefficient from the pre-filter coefficient candidate is determined every frame, for example, in a short time of about 20 ms. The code number showing the determined pre-filter coefficient information is outputted to the pre-filter 20*a* and the multiplexing unit 29*a*, and then is outputted to the speech decoding device through the transmission line.

The multiplexing unit 29*a* multiplexes the quantizing codes of predictive residual signals, the quantizing codes of predictive coefficients, and transmits the result to the speech decoding device through the transmission line.

Figure 4:
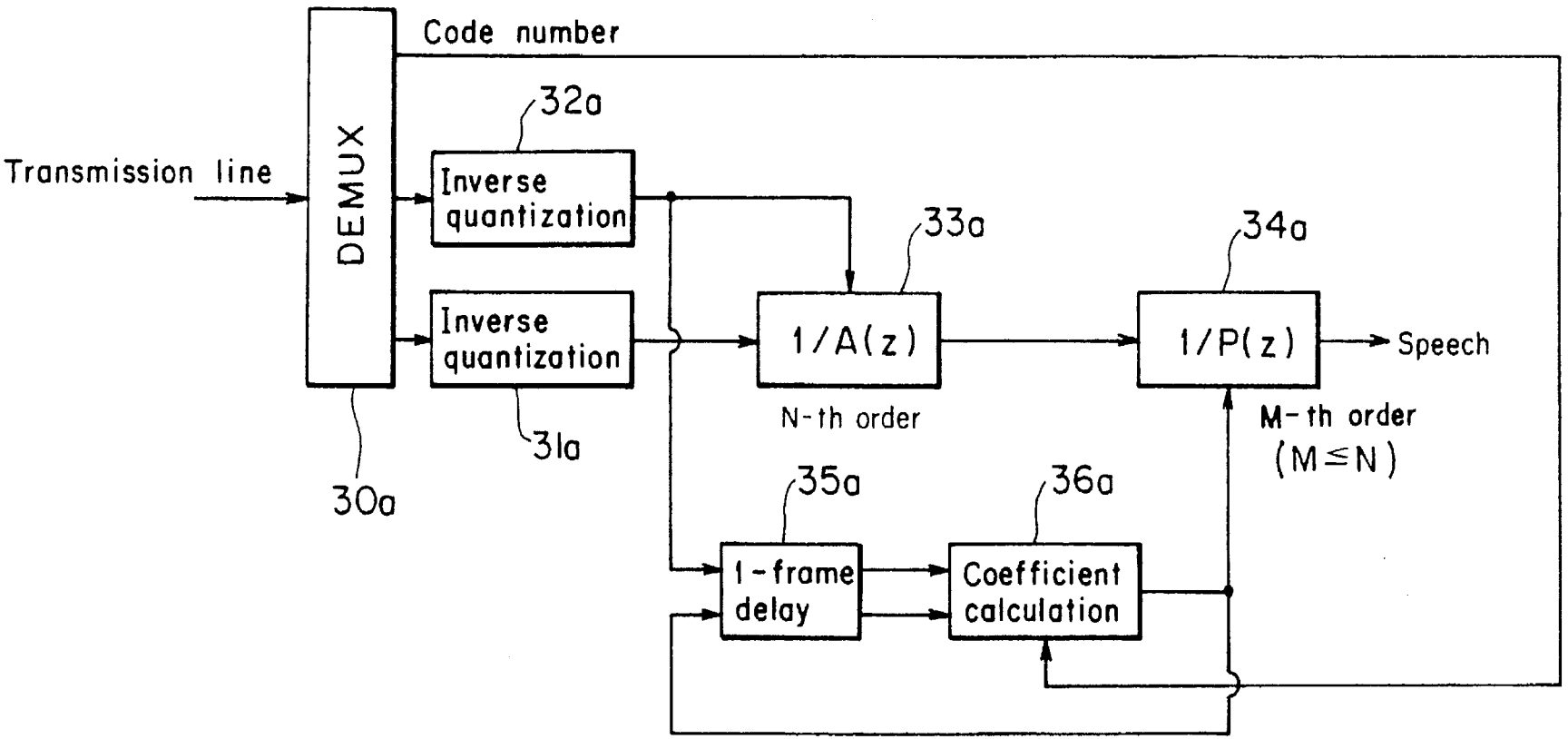
FIG. 4 is a block diagram showing a speech decoding device according to the first embodiment of the present invention.

FIG. 4 is a diagram showing a speech decoding device according to the first embodiment of the present invention. The speech decoding device, as shown in FIG. 4, executes substantially the procedure which is to the signal process in the speech coding device shown in FIG. 1. The speech decoding device includes an inverse quantizing unit 31*a* as an inverse quantizing means, a filter 33*a* as a third filter, a post process filter 34*a* as a fourth filter, a demultiplexing unit (DEMUX) 30*a*, a predictive coefficient inverse quantizing unit 32*a*, a frame delay unit 35*a*, and a coefficient calculating unit 36*a*.

The demultiplexing unit 30*a* demultiplexes a multiplexed signal inputted from the speech coding device via the transmission line. In this case, the multiplexed signal is separated into the quantizing codes of predictive residual signals, and the quantizing codes of predictive coefficients.

The inverse quantizing unit 31*a* inverse-quantizes a quantizing predictive residual signal based on a predictive residual signal quantizing code sent from the quantizing unit 22*a* in the speech coding device via the transmission. The predictive coefficient inverse quantizing unit 32*a* inverse-quantizes a quantizing predictive coefficient based on the predictive coefficient code sent from the predictive coefficient residual quantizing unit 23*a* via the transmission.

The filter 33*a* determines the filter characteristic based on a quantizing predictive residual coefficient obtained by the linear predictive analyzing unit 24*a* and the predictive coefficient quantizing unit 23*a* in the speech coding unit. The predictive residual signal from the inverse quantizing unit 31*a* is subjected to a filtering process using the resultant filter characteristic.

The post process filter 34*a* determines the filter characteristic based on a code number having a pre-filter coefficient information sent from the optimum coefficient selecting unit 28*a* in the speech coding device. The filter 33*a* executes a filtering process of the output signal in accordance with the resultant filter characteristic to output the outcome as a speech information.

The frame delay unit 35*a* inputs the predictive coefficient and the pre-filter coefficient inverse-quantized by the predictive coefficient inverse quantizing unit 32*a* to delay by 1-frame with respect to the current frame.

The coefficient calculating unit 36*a* inputs a code number showing a pre-filter coefficient information from the optimum coefficient selecting unit 28*a* and the predictive coefficient delayed from the frame delay unit 35*a* and calculates the filter coefficient of the post process filter 34*a* in the speech coding device.

When the code number as a pre-filter coefficient information from the optimum coefficient selecting unit 28*a* in the speech coding device has a characteristic which the pre-filter 20*a* passes an input speech signal without changing the signal characteristic, the post process filter 34*a* also has a characteristic which passes the input speech signal without any change in characteristic.

The speech coding device and the speech decoding device with the above configuration according to the first embodiment of the present invention will be explained below.

The pre-filter 20*a* executes an inverse filtering process of an input speech signal by using a desired pre-filter coefficient in a span where a change in the input spectrum is small and outputs the resultant a pre-filter predictive coefficient r1(n).

The inverse filter 21*a* executes an inverse filtering process on the pre-filter predictive residual signal r1(n) using a desired predictive coefficient to output a predictive residual signal r2(n).

Next, the quantizing unit 22*a* quantizes the predictive residual signal r2(n) and outputs the outcome to the multiplexing unit 29*a*. The predictive coefficient which determines the filter characteristic of the inverse-filter 21*a* is determined by inputting a pre-filter predictive residual signal r1(n) from the pre-filter 20*a* to the linear predictive analyzing unit 24*a* and then executing a linear predictive coding.

The pre-filter coefficients determining pre-filter characteristic of the prefilter 20*a* are determined as follows:

The frame delay unit 25*a* inputs the predictive coefficient information of a current frame and a pre-filter coefficient and extracts, for example, the predictive coefficient information and the pre-filter coefficient information of a frame preceding by 1-frame with respect to the current frame information.

The pre-filter coefficient candidate calculating unit 26*a* calculates a plurality of pre-filter coefficient candidates. Namely, the previous coefficient of the whole system including the pre-filter 20*a* is determined by subjecting the previous predictive coefficients and the pre-filter coefficients in an inputted previous frame to the convolutional operation given by the expression (4) in the convolutional operating unit 41*a*.

The first coefficients converting unit 42*a* converts the predictive coefficients of the whole system obtained by the convolutional operating unit 41*a* into the corresponding reflective coefficients. However, in concrete, the whole system predictive coefficients are determined by solving the expression (5).

The order truncating unit 43*a* truncates the lower coefficient of the (N+M)-th order reflective coefficients {kn} determined by the convolutional operating unit 41*a* and the first coefficient converting unit 42*a* to obtain the M-th order reflective coefficients.

The second coefficient converting unit 44*a* converts the reflective coefficients processed by the order truncating unit 43*a* into a predictive coefficient in accordance with the expression (6) to output the result as a pre-filter coefficient candidate.

The order converting operation using the above pre-filter coefficients means that the order cannot be truncated without processing the predictive coefficients.

There are two modes of the pre-filter coefficient candidate calculating methods. In one mode, the coefficient of the pre-filter 20*a* is a fixed M-th order and the pre-filter coefficient candidates calculated are accumulated and stored using the pre-filter coefficients and the predictive coefficients in plural past frames. The other mode, the coefficient of the pre-filter 20*a* is a variable order, and pre-filter coefficient candidates with various kinds of order are stored using the pre-filter coefficients and the predictive coefficients of, for example, the frame preceding by one frame.

The optimum coefficient selecting unit (selecting means) 28*a* selects a predictive coefficient candidate minimizing the predictive residual signal power as optimum predictive coefficients for the pre-filter from the plural pre-filter coefficient candidates determined by the pre-filter coefficient candidate calculating unit 26*a* and stored in the coefficient candidate code book 27*a*.

That is, in the optimum coefficient selecting unit 28*a*, the square OR operation unit 51*a* inputs a predictive residual signal r2(n) (where i=1~L) and executes a square OR operation of the absolute value thereof. The predictive residual signal r2(n) is obtained by subjecting each of pre-filter coefficient candidates of, for example, L in number stored in the coefficient code book 27*a* to an inverse filtering process by the pre-filter 20*a* and the inverse filter 21*a*.

The minimum value retrieving unit 25*a* retrieves the minimum value in the L values calculated by the square OR operating unit 51*a* and selects the pre-filter coefficient candidate based on the retrieved minimum value as optimum pre-filter coefficients.

The pre-filter coefficients selected as pre-filter coefficients of the current frame is outputted as a code number showing a pre-filter coefficient information to the pre-filter 20*a* and the multiplexing unit 29*a*, and then transmitted to the speech decoding device via the transmission line.

The optimum coefficients from the pre-filter coefficient candidates is determined every frame, for example, in a short time of about 20 ms. In the input speech signal having a large change in spectrum, the multiplexing unit 29*a* inputs the quantizing predictive residual signal, the quantizing predictive coefficients. In this case, since the pre-filter 20*a* has filter coefficients which pass a speech signal without changing its characteristic, the input speech signal is outputted as a pre-filter predictive residual signal r1(n) without any change.

In the similar manner to the process of a speech signal with a small change in spectrum, the inverse filter 21*a* determines predictive coefficients to the pre-filter predictive residual signal r1(n), executes an inverse filtering process using the predictive coefficients, and outputs as a predictive residual signal r2(n). The quantizing unit 22*a* quantizes the predictive residual signal r2(n) and outputs the result to the multiplexing unit 29*a*.

The filter coefficient of the pre-filter 20*a* which has the characteristic passing a speech signal through the pre-filter 20*a* without changing its signal characteristic is calculated by the pre-filter coefficient candidate calculating means 26*a*, and stored the outcome in the coefficient candidate code book 27*a*.

In the speech coding device, when the multiplexing unit 29*a* inputs a quantizing predictive residual signal, quantizing predictive coefficients, and a code number and outputs to the speech decoding device via the transmission line, the speech decoding device reproduces speech by processing substantially in reverse flow to the process in the speech coding device.

The input signal through the transmission line is demultiplexed into the quantizing code of a predictive residual signal, and the quantizing code of a predictive coefficient, by using the demultiplexing unit 30*a*. The inverse-quantizing unit 31*a* inverse-quantizes using the quantizing code of a predictive residual signal to output a predictive residual signal. The predictive coefficient inverse quantizing unit 32*a* inverse-quantizes using the quantizing code of a predictive coefficient to output a predictive coefficient.

The filter 33*a* determines its filter characteristic based on a predictive coefficient from the predictive coefficient inverse-quantizing unit 32*a* and subjects the predictive residual signal from the inverse-quantizing unit 31*a* to a filtering process in accordance with the inverse characteristic of the inverse filter 21*a*, using the filter characteristic. The frame delay unit 35*a* extracts a predictive coefficient of a previous frame delayed by one frame from the current frame to output to the coefficient calculating unit 36*a* and outputs a code number as a pre-filter coefficient information from the optimum coefficient selecting unit 28*a* to the coefficient calculating unit 36*a*.

The coefficient calculating unit 36*a* determines the filter characteristic of the post process filter 34*a* of the current frame based on the above coefficient information. A filter process is performed to the output of the filter 33*a* based on the filter characteristic to reproduce speech signal.

In the speech coding device and the speech decoding device according to the first embodiment of the present invention, when the interframe correlation of predictive coefficients are small, the pre-filter 20*a* has a characteristic not to change the characteristic of an input speech signal (or so as to make the pre-filter 20*a* off). When the interframe correlation of predictive coefficients is large, the pre-filter 20*a* is controlled so as to be on. Thus a higher predictive gain can be obtained, comparing the use of the conventional N-th order analyzing filter, by selecting the optimum one from a plurality of pre-filter coefficient candidates, filtering inversely it, and executing an N-order linear predictive coding. Therefore an effective speech transmission and reproduction can be realized advantageously with a high predictive gain maintained.

When the pre-filter 20*a* is in an ON state, a high predictive gain can be obtained by adding only a code number (log2 L bit) as a side information corresponding the number of the pre-filter coefficient candidates, in addition to the conventional predictive residual signal and the predictive coefficients, to the speech decoding device from the speech coding device.

(b) Explanation of the Second Embodiment

Figure 5:
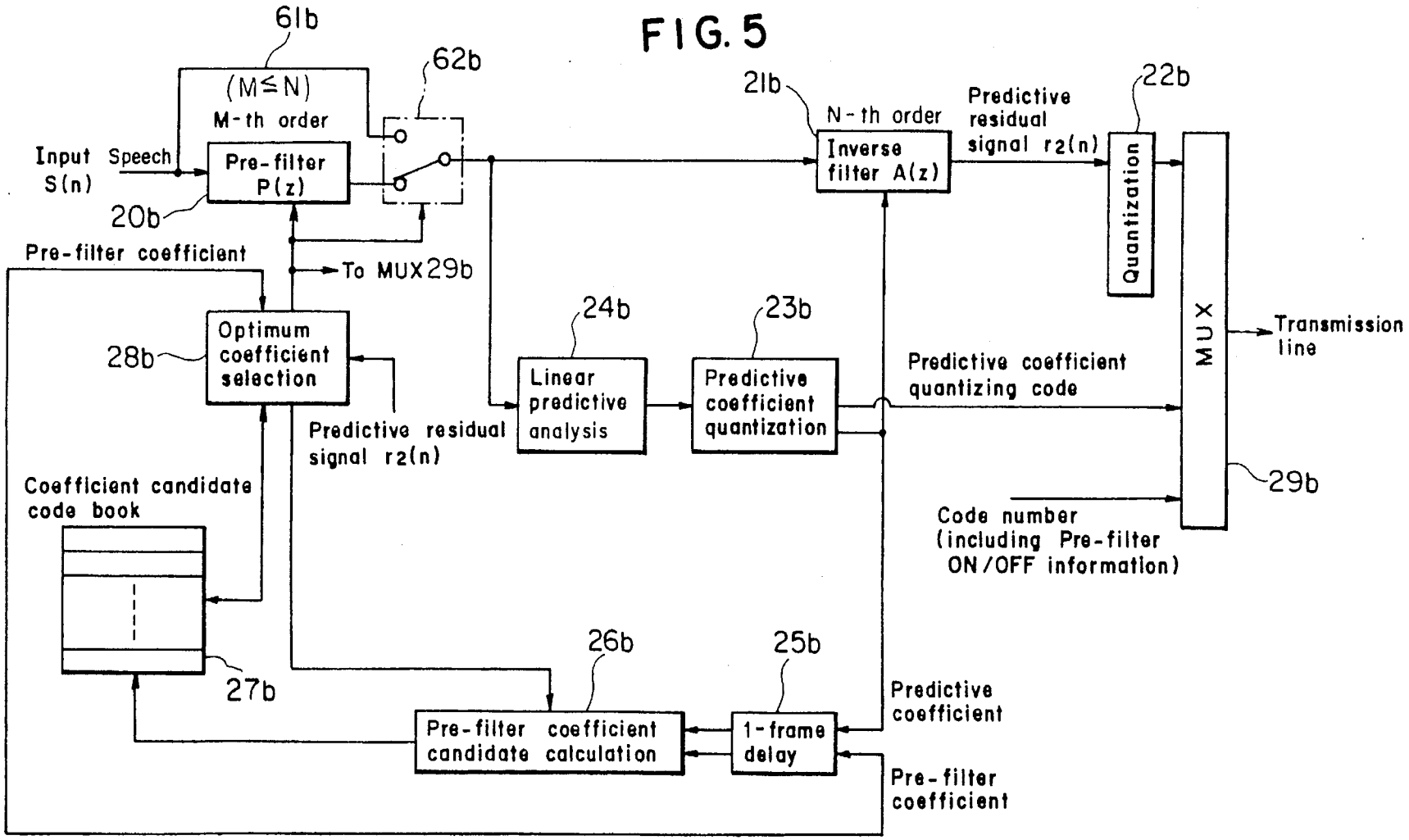
FIG. 5 is a block diagram showing a speech coding device according to the second embodiment of the present invention.

FIG. 5 is a diagram showing a speech coding device according to the second embodiment of the present invention. Referring to FIG. 5, a speech coding device is constituted of a pre-filter 20*b* as a first filter, a bypass route 61*b*, a selector 62*b*, an inverse filter 21*b* as a second filter, a quantizing unit 22*b* as quantizing means, linear predictive analyzing means 24*b*, a frame delay unit 25*b* as predictive coefficient calculating means for the first filter, a coefficient candidate code book 27*b*, and an optimum coefficient selection unit (sharing the function as selector control means) 28*b*.

The pre-filter 20*b*, an inverse filter 21*b*, a quantizing unit 22*b*, a linear predictive analyzing unit 24*b*, a frame delay unit 25*b*, and a multiplexing unit 29*b* have the same functions as those of elements in the first embodiment. Hence the overlapped explanation is omitted here.

The bypass route 61 by-passes the pre-filter 20*b*. The selector 62*b* selects the pre-filter 20*b* or the bypass route 61*b* and outputs a pre-filter predictive residual signal.

Figure 6:
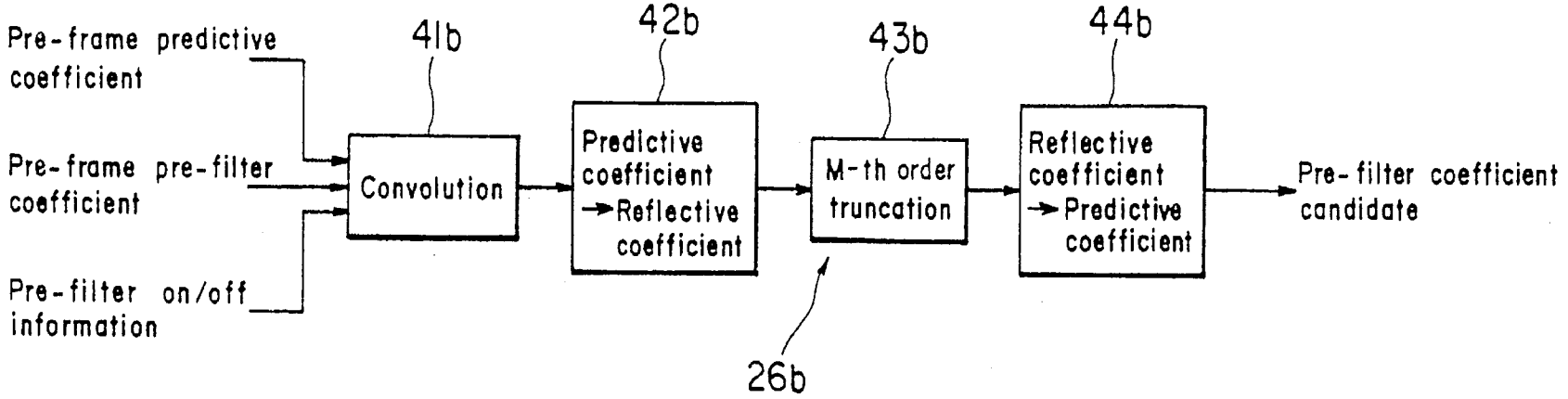
FIG. 6 is a block diagram showing a pre-filter candidate calculation unit according to the second embodiment of the present invention.

The pre-filter coefficient calculating unit 26*b* determines, for example, a plurality of pre-filter coefficient candidates with different order. The pre-filter coefficient calculating unit 26*b*, as shown in FIG. 6, is formed of a convolutional operation unit 41*b*, a first coefficient converting unit 42*b*, an order truncating unit 43*b*, and a second coefficient converting unit 44*b*.

In the similar manner to that in the first embodiment, the pre-filter coefficient calculating unit 26*b* determines the above filter coefficient candidate by the convolutional operation unit 41*b*, the first coefficient converting unit 42*b*, the order truncating unit 43*b*, and the second coefficient converting unit 44*b*. However, the second embodiment differs from the first embodiment in that the filter coefficient with a characteristic which passes an input speech signal through the pre-filter 20*b* without a change in the signal characteristic is not calculated as a pre-filter coefficient candidate.

In the similar manner to that in the first embodiment, the coefficient code book 27*b* stores a plurality of pre-filter coefficient candidates calculated in the pre-filter coefficient candidate calculating unit 26*b*. There are two aspects to calculate a plurality of pre-filter coefficient candidates stored in the code book 27*b*, as seen similarly in the first embodiment. However, the filter coefficient which has a characteristic passing an input speech signal through the pre-filter 20*b* without a change in the signal characteristic is not stored in the coefficient code book.

Figure 7:
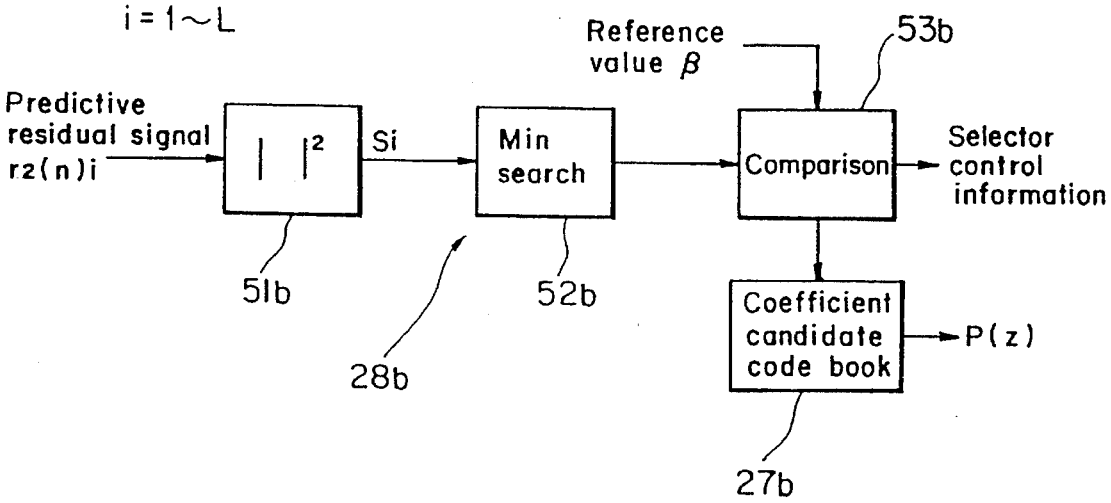
FIG. 7 is a block diagram showing the optimum coefficient selection unit according to the second embodiment of the present invention.

Like the optimum coefficient selecting unit 28*a* in the first embodiment, the optimum coefficient selecting unit 28*b* selects a predictive coefficient candidate minimizing a predictive residual signal from a plurality of pre-filter coefficient candidates determined by the pre-filter coefficient candidate calculating unit 26*b*. As shown in FIG. 7, the optimum coefficient selecting unit 28*b* is constituted of a square OR operation unit 51*b*, a minimum value retrieving unit 52*b*, and a comparing unit 53*a*.

The square OR operation unit 51*b* and the minimum value retrieving unit 52*b* have respectively the same functions as the square OR operation unit 51*a* and the minimum value retrieving unit 52*a* in the first embodiment. The comparing unit 53*b* compares the minimum value regarding a retrieved operating value with the reference value β in amplitude.

When the minimum value is smaller than the reference value β, a pre-filter coefficient candidate based on a predictive residual signal at the minimum value is selected as a optimum pre-filter coefficient and the corresponding code number is issued to the multiplexing unit 29*b*. At the same time, the selector 62*b* selects the pre-filter 20*b* to output a control signal as a selector selecting signal and a pre-filter ON information to the pre-filter coefficient candidate calculating unit 26*b*.

When the minimum value is larger than the reference value β, the comparing unit 53*b* outputs a control signal by which the selector 62*b* selects the bypass route 61*b* and outputs a pre-filter OFF information to the pre-filter coefficient candidate calculating unit 26*b*.

Figure 8:
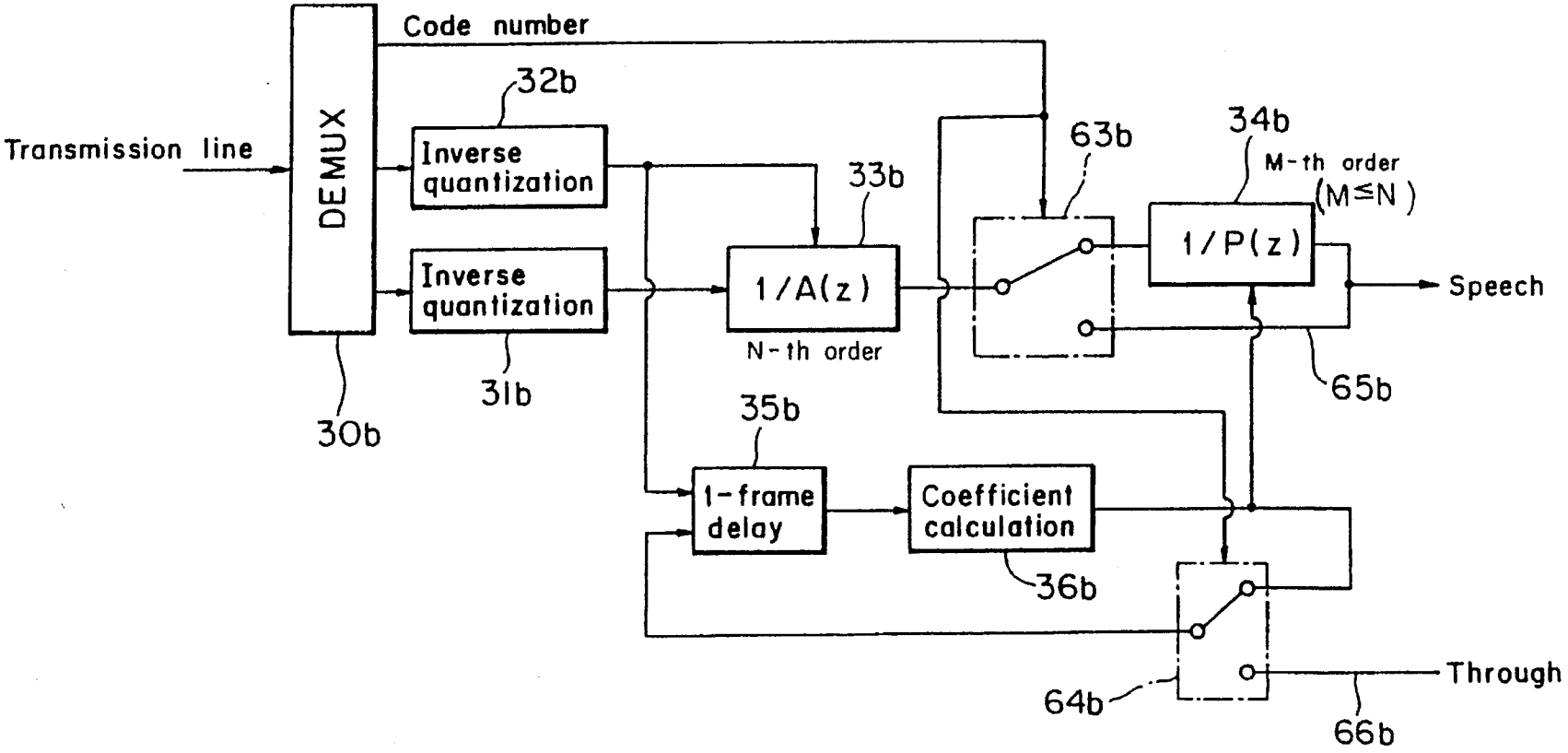
FIG. 8 is a block diagram showing a speech decoding device according to the second embodiment of the present invention.

FIG. 8 is a diagram showing a speech decoding device according to the second embodiment of the present invention. The speech decoding device is constituted of an inverse quantizing unit 31*b* as inverse quantizing means, a filter 33*b* as the third filter, a post processing filter 34*b* as the fourth filter, a demultiplexing unit (DEMUX) 30*b*, a predictive coefficient inverse quantizing unit 32*b*, a frame delay unit 35*b*, a coefficient calculating unit 36*b*, a selector 64*b* for the post processing filter, a selector 64*b* for the coefficient calculating unit, a bypass route 65*b* for the post processing filter, and a bypass route 66*b* for the coefficient calculating unit.

The inverse quantizing unit 31*b*, the filter 33*b*, the post processing filter 34*b*, the demultiplexing unit (DEMUX) 30*b*, the predictive coefficient quantizing unit 32*b*, and the frame delay unit 35*b* correspond to the inverse quantizing unit 31*a*, the filter 33*a*, the post processing filter 34*a*, the demultiplexing unit (DEMUX) 30*a*, the predictive coefficient inverse-quantizing unit 32*a*, and the frame delay unit 35*a* in the first embodiment. Hence the duplicate explanation is omitted here.

The selector 63*b* for the post processing filter selects either the post processing filter 34*b* or the bypass route 65*b* for the post processing filter based on the code number from the optimum coefficient selecting unit 28*b* in the speech coding device.

The selector 64*b* for the coefficient calculation unit selects either the a previous coefficient information calculated by the coefficient calculating unit 36*b* or the bypass route 66*b* for the coefficient calculating unit in a through state where a coefficient is not inputted to the coefficient calculating unit 36*b*, based on the code number from the optimum coefficient selection unit 28*b*.

The speech coding device and the speech decoding device according to the second embodiment of the present invention have the above configuration and operate as follows:

When the input speech signal includes an input spectrum with a short changing span such as a stationary voiced periods, the square sum (power value) of the predictive residual signal from the optimum coefficient selecting unit 28*b* is smaller than the reference value.

Therefore in the speech coding device, the selector 62*b* selects the pre-filter 20*b*. This operation is similar to the inverse filtering process of the pre-filter 20*a* in the first embodiment.

In this case, in the decoding device, the selector 63*b* for the post processing filter selects the post processing filter 34*b*. The selector 64*b* for the coefficient calculating unit selects a previous coefficient information calculated by the coefficient calculating unit 36*b*. Therefore, the speech decoding device operates as the pre-filter 20*a* in the first embodiment performs an inverse filtering process.

In an input speech signal having a large spectrum input signal, when a square OR operation value of a predictive residual signal in the optimum coefficient selecting unit 28*b* is larger than a reference value, the selector 62*b* selects the bypass route 61*b*.

Like the pre-filter 20*a* in the first embodiment which outputs as a pre-filter predictive residual signal without any change in characteristic, a quantizing code of a predictive residual signal, a quantizing code of a predictive coefficient, and a code number including a pre-filter ON/OFF information are outputted.

The comparing unit 53*b* in the optimum coefficient selecting unit 28*b* outputs a control signal to select the bypass route 61*b* by the selector 62*b*. At the same time, the comparing unit 53*b* outputs a code number including a pre-filter OFF information to the multiplexing unit 29*b* and outputs a pre-filter OFF information to the pre-filter coefficient candidate calculating unit 26*b*.

In this case, in the speech decoding device, the selector for the post processing filter 63*b* selects the bypass route 65*b* for the post processing filter, and the selector 64*b* for the coefficient calculating unit selects the bypass route 66*b* for the coefficient calculating unit. Hence in the speech decoding device, the above same selectors operate in the similar manner that the pre-filter 20*a* in the first embodiment performs the filtering operation in accordance with a pre-filter coefficient passing through an input speech signal without a change in characteristic.

Thus, according to the speech coding device and a speech decoding device of the second embodiment of the present invention, when the interframe correlation of predictive coefficients are small, input speech signals are passed through the bypass route 61*b* by-passing the pre-filter 20*b* without a change in its characteristic (the pre-filter 20*b* is in off-state). When the interframe correlation of predictive coefficients is large, the pre-filter 20*b* is controlled so as to be in ON-state and the optimum candidate is selected from a plurality of pre-filter coefficient candidates. Sequentially the candidate is subjected to an inverse filtering process and then subjected to an N-th order linear predictive coding. As a result, a higher predictive gain is established comparing the use of only the conventional N-th order analyzing filter. There is an advantage in that an effective speech transmission and reproduction can be realized with a high predictive gain maintained.

When the pre-filter 20*a* is in an on state, a higher predictive gain can be obtained by adding only a code number as a side information in the speech coding device and the speech decoding device, the side information corresponding to the number of pre-filter coefficient candidates and including on/off information of the pre-filter 20*b* in addition of the conventional predictive residual signal and the predictive coefficient.

(c) Explanation of the Third Embodiment

Figure 9:
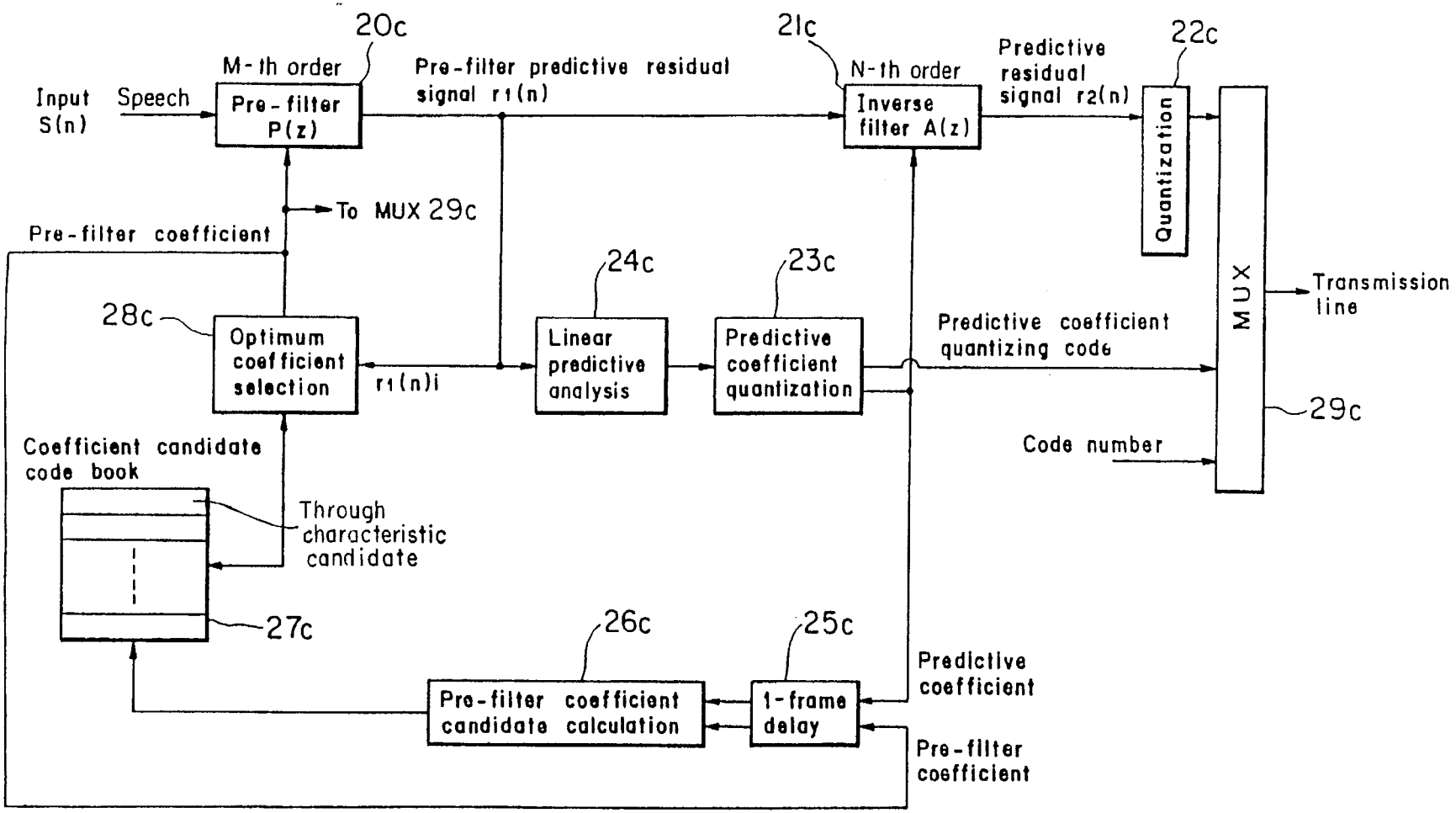
FIG. 9 is a block diagram showing a speech coding device according to the third embodiment of the present invention.

FIG. 9 is a diagram showing a speech coding device according to the third embodiment of the present invention. The speech coding device shown in FIG. 9 is different from that of the first embodiment in that the optimum coefficient selecting unit 28*c* is of a different.

Figure 10:
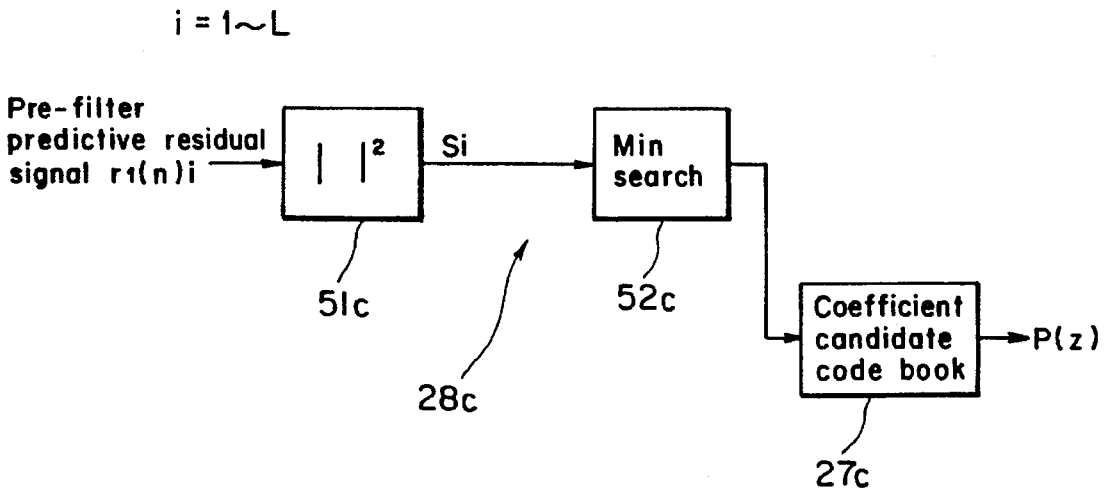
FIG. 10 is a block diagram showing the optimum coefficient selection unit of a speech coding device according to the third embodiment of the present invention.

The optimum coefficient selecting unit 28*c*, as shown in FIG. 10, is formed of a square OR operation unit 51*c* and a minimum retrieving unit 52*c*. There is a difference in that the square OR operation unit 51*a* inputs each of pre-filter coefficient candidates of L in number stored in the coefficient code book 27*a* as pre-filter predictive residual signal r1(n)i(i=1~L) subjected to a pre-filtering process by the pre-filter 20*a* and executes a square OR operation of the absolute value. The minimum value retrieving unit 52*c* functions similarly to that in the first embodiment.

Figure 11:
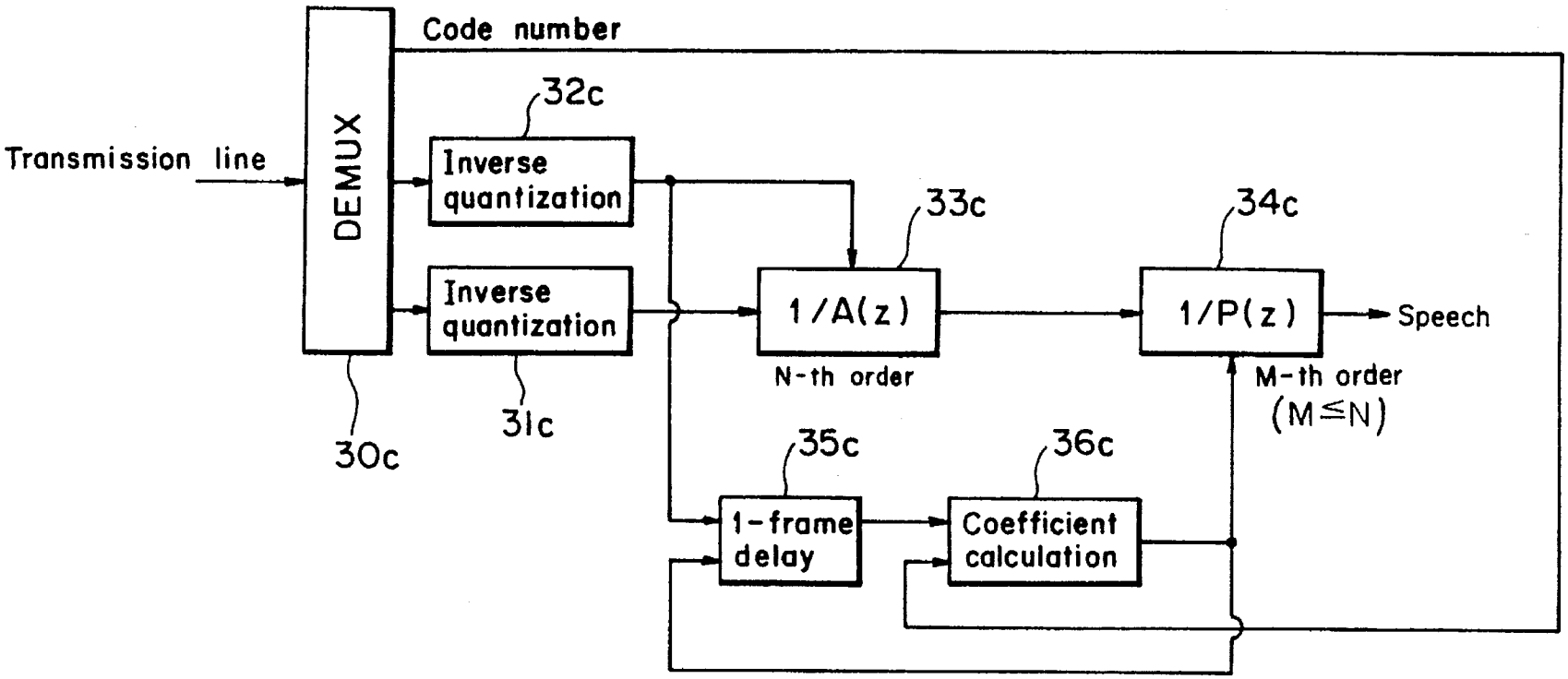
FIG. 11 is a block diagram showing a speech decoding device according to the third embodiment of the present invention.

FIG. 11 is a block diagram showing a speech decoding device according to the third embodiment of the present invention. Since the speech decoding device shown in FIG. 11 is similar to that in the first embodiment, the duplicate explanation will be omitted here.

According to the present invention, the speech coding device and the speech decoding device having the above configuration operates in the same manner to those in the first embodiment as the whole system. However, this embodiment is different from the first embodiment in a predictive residual signal inputted to the optimum coefficient selecting unit 28*c*.

In the speech coding device and the speech decoding device according to the third embodiment of the present invention, there is an advantage in that in order to select the optimum pre-filter coefficient in the optimum coefficient selecting unit 28*c*, even if a pre-filter predictive residual signal is inputted, an effective speech transmission and reproduction can be realized, like in the first and second embodiments, with a high predictive gain maintained, instead of a predictive residual signal from the inverse filter 21*c*.

In this case, when the pre-filter 20*c* is in ON state, the speech coding device adds only the code number as a side information corresponding to the number of the pre-filter coefficient candidates in addition to the conventional predictive residual signals and the predictive coefficients to the speech decoding device whereby a high predictive gain can be established.

(d) Explanation of the Fourth Embodiment

Figure 12:
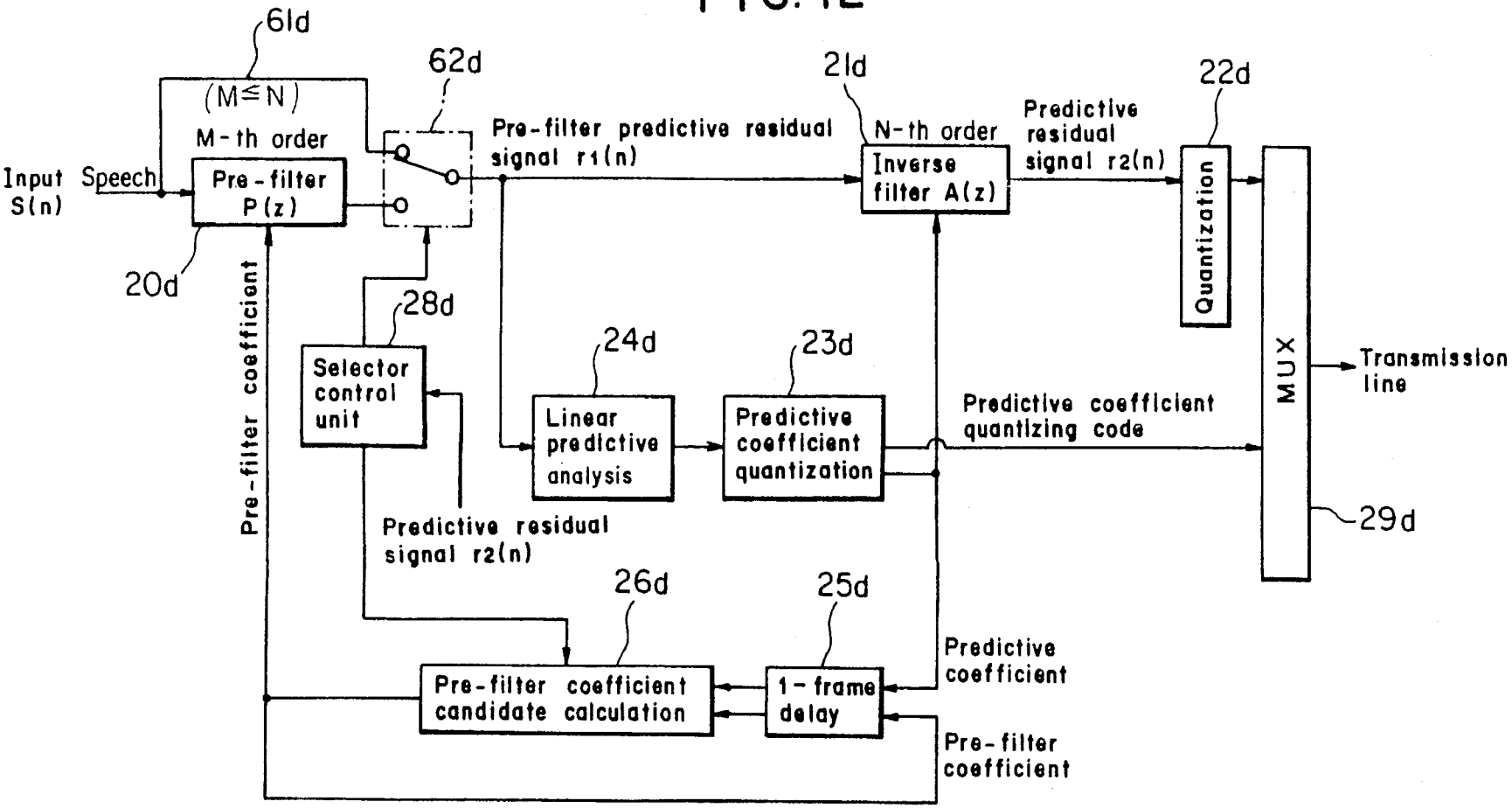
FIG. 12 is a block diagram showing a speech coding device according to the fourth embodiment of the present invention.
Figure 13:
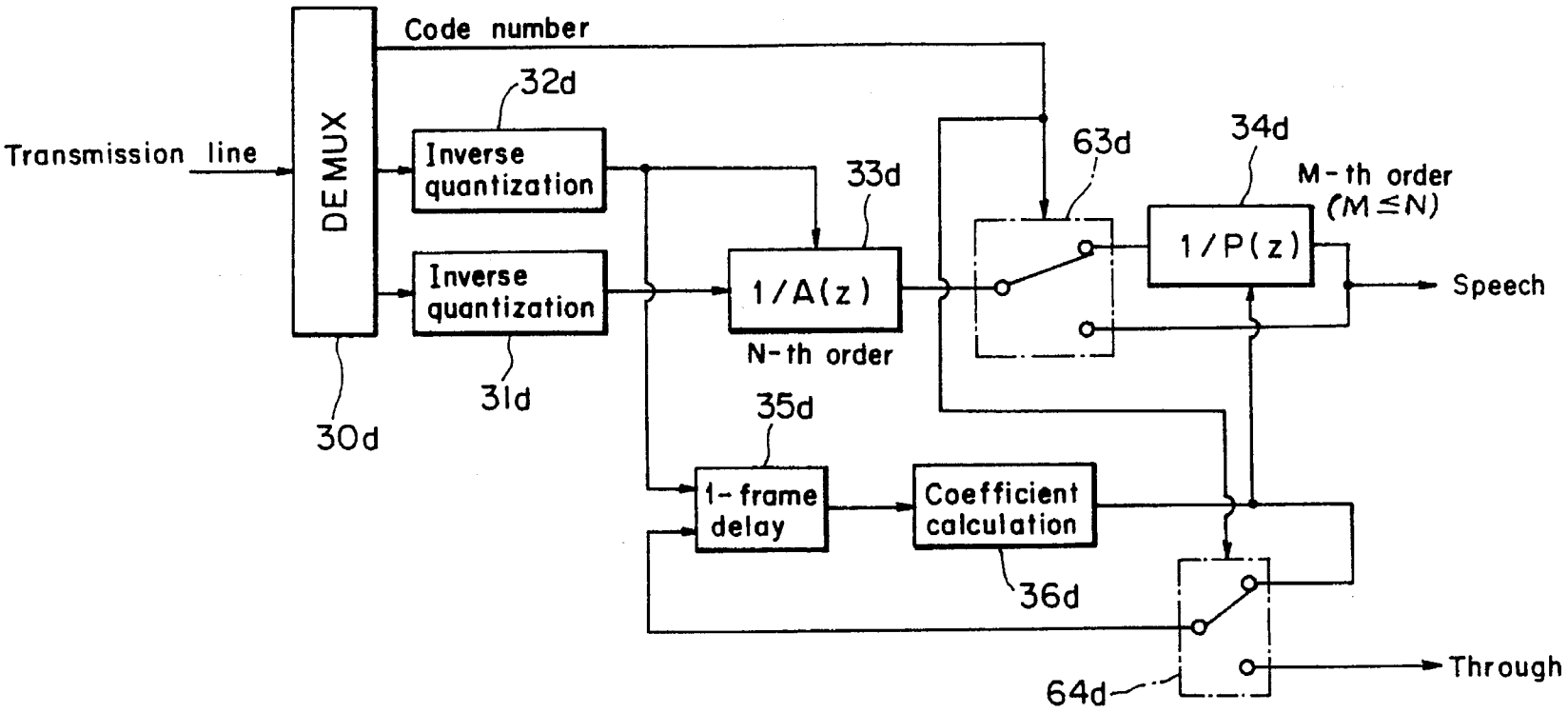
FIG. 13 is a block diagram showing a speech decoding device according to the fourth embodiment of the present invention.
Figure 14:
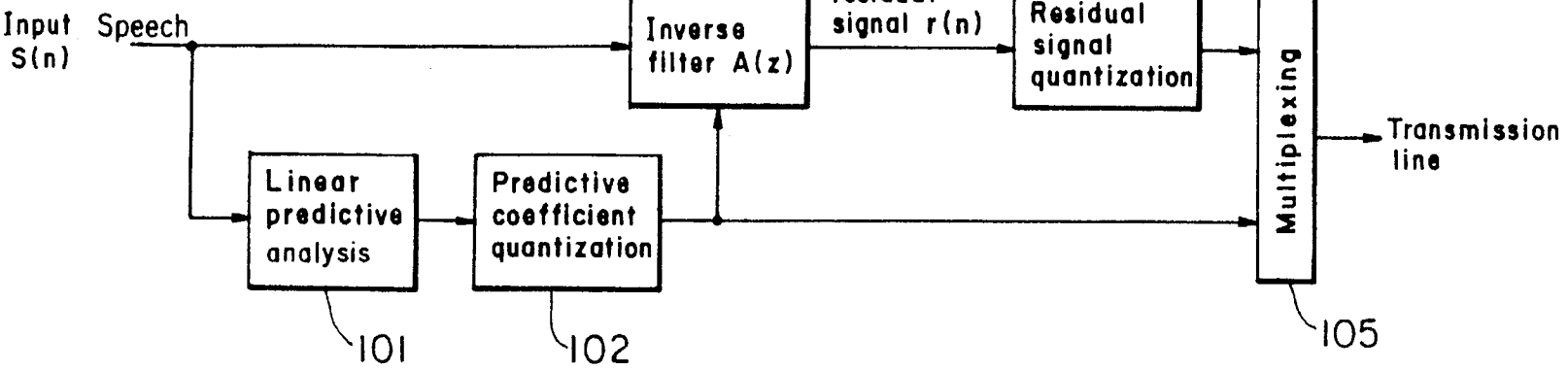
FIG. 14 PRIOR ART
FIG. 14 is a block diagram showing a conventional speech coding device.
Figure 15:
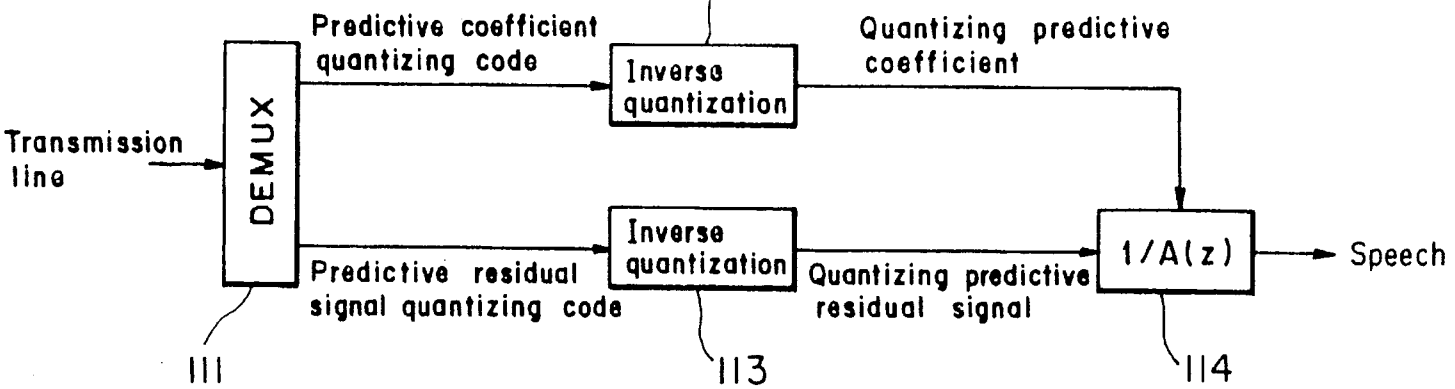
FIG. 15 PRIOR ART
FIG. 15 is a block diagram showing a conventional decoding device.

FIG. 12 is a diagram showing a speech coding device according to the fourth embodiment of the present invention. The speech coding device shown in FIG. 12 differs from that in the second embodiment in that there is no coefficient candidate code book 27*b* and a selector control unit 28*d* functioning only as selector control means in place of the optimum coefficient selecting unit 28*b*. Other elements are similar to those in the second embodiment.

That is, the pre-filter 20*d* is uniquely determined as a pre-filter coefficient from coefficient candidates calculated by the pre-filter coefficient calculating unit 26*d*. When the square OR operation value on the predictive residual signal r2(n) is smaller than the reference value β, the selector control unit 28*d* outputs a control signal so that the selector 62*d* is selectively connected to the pre-filter 20*d*. When the square OR operation value β is large, the selector 62*d* outputs a control signal and connects selectively to the by-pass route 61*d*.

In the speech coding device and the speech decoding device having the above configuration according to the fourth embodiment of the present invention, when the selector 62*d* selects the pre-filter 20*d*, the coefficient of the pre-filter 20*d* is uniquely determined as a pre-filter coefficient of a current frame in accordance with the M-th order coefficient of the previous frame. Other elements operate in the similar manner to those in the second embodiment.

According to the fourth embodiment of the present invention, when the interframe correlation of the predictive coefficient is small, the pre-filter 20*b* is by-passed by the bypass route 61*b* without changing the characteristic of the input speech signal (or the pre-filter 20*b* is made to an OFF state). When the interframe correlation of the predictive coefficient is large, the pre-filter 20*b* is made to an ON state and an N-th order linear predictive coding is performed. As a result, a higher predictive gain can be obtained as compared with the prior art using only an N-order coding filter. There is an advantage in that an effective speech transmission and reproduction can be realized with a high predictive gain maintained.

When the pre-filter 20*b* is in an ON state, a higher predictive gain can be advantageously obtained by adding an ON/OFF information of the pre-filter 20*d* in addition to an normal predictive residual signal and a predictive coefficient.

What is claimed is:

1. A speech coding method comprising the steps of:

subjecting an input speech signal to an inverse filtering process by a first filter using a coefficient determined by a first predictive coefficient for said first filter and a second predictive coefficient for a second filter and obtaining a first predictive residual Signal from said first filter, said first predictive coefficient for said first filter and said second predictive coefficient for said second filter being obtained by analyzing a previous frame;

subjecting said first predictive residual signal obtained in said inverse filtering process by said first filter to a linear predictive analysis to obtain said second predictive coefficient;

performing an inverse filtering process by said second filter using said second predictive coefficient from said linear predictive analysis and obtaining a second predictive residual signal; and quantizing said second predictive residual signal obtained by the inverse filtering process by said second filter.

2. A speech coding device comprising:

a first filter for performing an inverse filtering process on an input speech signal and issuing a first predictive residual signal;

a second filter, coupled to said first filter, for performing an inverse filtering process on said first predictive residual signal from said first filter and issuing a second predictive residual signal;

quantizing means, coupled to said second filter, for quantizing said second predictive residual signal from said second filter;

linear predictive analyzing means, coupled to said first filter and said second filter, for performing a linear predictive analysis based on said first predictive residual signal from said first filter and extracting a second predictive coefficient for said second filter to determine a filter characteristic of said second filter; and calculating means for said first filter for calculating a first predictive coefficient for said first filter to determine a filter characteristic of said first filter, using a predictive coefficient for said first filter of a previous frame and a predictive coefficient for said second filter of said previous frame;

wherein said first filter determines the filter characteristic thereof based on said first filter predictive coefficient obtained by said calculating means, performs an inverse filtering process on said input speech signal in accordance with said filter characteristic thereof, and issues said first predictive residual signal; and wherein said second filter determines a filter characteristic thereof based on said second filter predictive coefficient extracted by said linear predictive analyzing means, performs an inverse filtering process on said first predictive residual signal in accordance with said filter characteristic of said second filter, and issues said second predictive residual signal.

3. A speech coding device according to claim 2, wherein said first filter has an order smaller than an order of said second filter.

4. A speech coding device according to claim 2, wherein said calculating means for the first filter comprises:

total predictive coefficient calculating means for determining a total predictive coefficient from said predictive coefficient for said first filter and said predictive coefficient for said second filter of a previous frame;

first converting means for converting said total predictive coefficient determined by said total predictive coefficient calculating means into a reflective coefficient;

order truncating means for truncating said reflective coefficient received after converting by said first converting means with respect to an order of said first filter; and second converting means for converting said reflective coefficient after truncating by said order truncating means into said first predictive coefficient for said first filter.

5. A speech coding device according to claim 2, wherein said calculating means for said first filter comprises predictive coefficient candidate selecting means for determining a plurality of predictive coefficient candidates for said first filter; and selecting means for selecting an optimum predictive coefficient for said first filter from predictive coefficient candidates selected by said predictive coefficient candidate selecting means.

6. A speech coding device according to claim 5, wherein said predictive coefficient candidate selecting means comprises:

total predictive coefficient calculating means for determining a plurality of total predictive coefficients from said first predictive coefficient for said first filter and said second predictive coefficient for said second filter of a plurality of previous frames;

first converting means for converting a plurality of total predictive coefficients obtained by said total predictive coefficient calculating means into a plurality of corresponding reflective coefficients;

order truncating means for truncating a plurality of reflective coefficients converted by said first converting means with respect to a corresponding order of said first filter; and second converting means for converting a plurality of reflective coefficients processed by said order truncating means into predictive coefficient candidates for the first filter.

7. A speech coding device according to claim 5, wherein said predictive coefficient candidates for said first filter include a coefficient to provide that said first filter has a through-characteristic.

8. A speech coding device according to claim 5, wherein said selecting means selects as said first predictive coefficient for said first filter a predictive coefficient candidate minimizing a predictive residual signal power, from a predictive coefficient candidate selected by said predictive candidate selecting means.

9. A speech coding device comprising:

a first filter for performing an inverse filtering process on an input speech signal and issuing a first predictive residual signal;

a first filter for performing an inverse filtering process on an input speech signal and issuing a first predictive residual signal;

by-pass route means for by-passing said first filter;

a selector, coupled to said first filter and said by-pass route means, for selecting said first filter or said by-pass route means;

a second filter, coupled to said selector, for performing an inverse filtering process on a signal selected by said selector and issuing a second predictive residual signal;

quantizing means, coupled to said second filter, for quantizing said second predictive residual signal from said second filter;

linear predictive analyzing means, coupled to said selector, for performing a linear predictive analysis based on a signal selected by said selector and for extracting a second filter predictive coefficient for said second filter to determine a filter characteristic of said second filter;

calculating means for said first filter for calculating said first predictive coefficient for said first filter using a predictive coefficient for said first filter of a previous frame and a predictive coefficient for said second filter of said previous frame to determine a filter characteristic of said first filter; and selector control means for switching said selector based on a predictive residual signal applied thereto;

wherein said selector selects an output from said first filter or said input speech signal sent via said by-pass route means in response to said predictive residual signal and said second filter determines a filter characteristic thereof based on said second predictive coefficient extracted by said linear predictive analyzing means, performs an inverse filtering process on said first predictive residual signal or said input speech signal in accordance with the filter characteristic thereof, and issues said second predictive residual signal.

10. A speech decoding method for decoding a signal from a speech coding device which includes a first filter for performing an inverse filtering process on an input speech signal and issuing a first predictive residual signal, a second filter for performing an inverse filtering process on said first predictive residual signal from said first filter and issuing a second predictive residual signal, quantizing means for quantizing said second predictive residual signal from said second filter, linear predictive analyzing means for performing a linear predictive analysis based on said first predictive residual signal from said first filter and extracting a predictive coefficient for said second filter to determine a filter characteristic of said second filter, and calculating means for said first filter for calculating a predictive coefficient for said first filter to determine a filter characteristic of said first filter, using a predictive coefficient for said first filter of a previous frame and a predictive coefficient for said second filter of said previous frame, wherein said first filter determines a filter characteristic thereof based on said predictive coefficient for the first filter obtained by said calculating means, performs an inverse filtering process on said input audio signal in accordance with said filter characteristic thereof and issues said first predictive residual signal, and wherein said second filter determines a filter characteristic thereof based on said predictive coefficient extracted by said linear predictive analyzing means, performs an inverse filtering process on said first predictive residual signal in accordance with said filter characteristic thereof, and issues said second predictive residual signal, the speech decoding method comprising the steps of:

performing an inverse quantization on a quantized predictive residual signal in accordance with a quantizing code received from said quantizing means of said speech coding device;

subjecting an inverse-quantized predictive residual signal to a composite filtering process by a third filter using a predictive coefficient received from said linear predictive analyzing means of said speech coding device; and subjecting an output of said third filter to a composite filtering process by a fourth filter to determine a filter characteristic based on predictive coefficient information received from said calculating means of said speech coding device.

11. A speech decoding device in combination with a speech coding device which includes a first filter for performing an inverse filtering process on an input speech signal and issuing a first predictive residual signal, a second filter for performing an inverse filtering process on said first predictive residual signal from said first filter and issuing a second predictive residual signal, quantizing means for quantizing said second predictive residual signal from said second filter, linear predictive analyzing means for performing a linear predictive analysis based on said first predictive residual signal from said first filter and extracting a predictive coefficient for said second filter to determine a filter characteristic of said second filter, and calculating means for said first filter for calculating a predictive coefficient for said first filter to determine a filter characteristic of said first filter, issuing a predictive coefficient for said first filter of a previous frame and a predictive coefficient for said second filter of said previous frame, wherein said first filter determines a filter characteristic thereof based on said predictive coefficient obtained by said calculating means for said first filter, performs an inverse filtering process on said input speech signal in accordance with said filter characteristic, and issues said first predictive residual signal and wherein said second filter determines a filter characteristic thereof based on said predictive coefficient extracted by said linear predictive analyzing means, performs an inverse filtering process on said first predictive residual signal in accordance with said filter characteristic thereof, and issues said second predictive residual signal, the decoding device comprising:

inverse-quantizing means for inverse-quantizing a quantized predictive residual signal in accordance with a quantizing code received from said quantizing means of said speech coding device;

a third filter for determining a filter characteristic thereof based on a predictive coefficient received from said linear predictive analyzing means of said speech coding device and for subjecting the predictive residual signal inverse-quantized by said inverse-quantizing means to a filtering process in accordance with said filter characteristic thereof; and a fourth filter for determining a filter characteristic thereof based on a predictive coefficient received from said calculating means of said speech coding device and for subjecting an output signal from said third filter to a filtering process using said filter characteristic of said fourth filter.

12. An audio decoding device according to claim 11, wherein said fourth filter has an order which is lower than an order of said third filter.

13. An audio decoding device in combination with a speech coding device which includes a first filter for performing an inverse filtering process on an input speech signal and issuing a first predictive residual signal, by-pass pass route means for by-passing said first filter, a selector for selecting said first filter or said by-pass route means, a second filter for performing an inverse filtering process on a signal selected by said selector and issuing a second predictive residual signal, quantizing means for quantizing said second predictive residual signal from said second filter, linear predictive analyzing means for performing a linear predictive analysis based on a signal selected by said selector and for extracting a predictive coefficient for said second filter to determine a filter characteristic of said second filter, calculating means for said first filter for calculating said predictive coefficient for the first filter using a predictive coefficient for said first filter of a previous frame and a predictive coefficient for said second filter of said previous frame to determine a filter characteristic of said first filter and selector control means for switching said selector based on a predictive residual signal, wherein said selector selects an output from said first filter or said input speech signal sent via said by-pass route means in response to said predictive residual signal and said second filter determines a filter characteristic thereof based on said second filter predictive coefficient extracted by said linear predictive analyzing means, performs an inverse filtering process on said first predictive residual signal or said input speech signal in accordance with the obtained filter characteristic, and issues said second predictive residual signal, the speech decoding device comprising:

inverse-quantizing means for inverse-quantizing a quantized predictive residual signal received from said quantizing means of said speech coding device;

a third filter for determining a filter characteristic thereof based on a predictive coefficient sent from a linear predictive analyzing means of said speech coding device and subjecting a predictive residual signal inverse-quantized by said inverse-quantizing means to a filter process using said filter characteristic;

a selector for switching between one switching route and another switching route in accordance with a selector switching information received from said selector control means of said speech coding means;

a fourth filter connected to one switching route of said selector for subjecting an output of said selector to a filtering process; and a by-pass route means connected to another switching route of said selector for by-passing said fourth filter.

14. An audio decoding device according to claim 13, wherein said fourth filter has an order which is lower than an order of said third filter.

* * * * *

UNITED STATES PATENT AND TRADEMARK OFFICE

CERTIFICATE OF CORRECTION

PATENT NO. : 5,465,316

DATED : November 7, 1995

INVENTOR(S) : Yoshinori TANAKA

It is certified that error appears in the above-indentified patent and that said Letters Patent is hereby corrected as shown below:

On the title page, item [75], delete "Yosahinori" and insert --Yoshinori--.

Signed and Sealed this

Eighteenth Day of February, 199

*Attest:*

*Attesting Officer*

BRUCE LEHMAN

*Commissioner of Patents and Trademarks*